US009473847B2

(12) United States Patent
Shiozawa et al.

(10) Patent No.: US 9,473,847 B2
(45) Date of Patent: Oct. 18, 2016

(54) ACOUSTIC APPARATUS

(71) Applicant: Yamaha Corporation, Hamamatsu-shi, Shizuoka-Ken (JP)

(72) Inventors: Yasuo Shiozawa, Heverlee (BE); Koji Okazaki, Hamamatsu (JP); Hirofumi Onitsuka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/199,650

(22) Filed: Mar. 6, 2014

(65) Prior Publication Data

US 2014/0254839 A1 Sep. 11, 2014

(30) Foreign Application Priority Data

Mar. 7, 2013 (JP) ..... 2013-045964

(51) Int. Cl.
*H04R 1/20* (2006.01)
*H04R 1/28* (2006.01)

(52) U.S. Cl.
CPC ..... *H04R 1/20* (2013.01); *H04R 1/2888* (2013.01); *H04R 1/288* (2013.01)

(58) Field of Classification Search
CPC ..... H40R 1/20; H40R 1/2888; H40R 1/2853–1/68; H40R 1/1016; H40R 1/2826; H40R 1/2819; H40R 1/2873; G10K 11/025; G10K 11/002
See application file for complete search history.

(56) References Cited

U.S. PATENT DOCUMENTS

| | | | | | |
|---|---|---|---|---|---|
| 1,832,763 | A | * | 11/1931 | Campbell | G10K 11/025 181/193 |
| 4,031,318 | A | * | 6/1977 | Pitre | 381/386 |
| 4,616,731 | A | | 10/1986 | Robinson | |
| 4,930,596 | A | * | 6/1990 | Saiki et al. | 181/152 |
| 4,933,982 | A | * | 6/1990 | Tanaka | 381/349 |
| 4,969,196 | A | | 11/1990 | Nakamura | |
| 5,177,329 | A | * | 1/1993 | Klayman | H04R 1/2842 181/156 |
| 5,373,564 | A | | 12/1994 | Spear et al. | |

(Continued)

FOREIGN PATENT DOCUMENTS

| | | |
|---|---|---|
| JP | 2606447 B2 | 5/1997 |
| JP | 3763682 B2 | 4/2006 |

(Continued)

OTHER PUBLICATIONS

Mechanical English translation of document B1 (JP 2606447 B2) previously filed on Mar. 6, 2014.

(Continued)

*Primary Examiner* — Fan Tsang
*Assistant Examiner* — Angelica M McKinney
(74) *Attorney, Agent, or Firm* — Crowell & Moring LLP

(57) ABSTRACT

An acoustic apparatus includes a vibration part configured to generate an acoustic vibration, a tube having a cavity that faces the vibration part, and at least one open tube connected to the tube via a first open end and a second open end. A length of the at least one open tube is an integer-fold of substantially a half of a wavelength of a standing wave produced in the tube. The first open end is positioned substantially at an anti-node of the standing wave produced in the tube.

14 Claims, 7 Drawing Sheets

(56) References Cited

U.S. PATENT DOCUMENTS

| | | | | |
|---|---|---|---|---|
| 5,714,721 | A | 2/1998 | Gawronski et al. | |
| 5,875,255 | A * | 2/1999 | Campbell | H04R 1/2819 181/199 |
| 6,002,781 | A * | 12/1999 | Takayama et al. | 381/338 |
| 6,032,464 | A * | 3/2000 | Swift et al. | 60/520 |
| 6,324,292 | B1 | 11/2001 | Mitsuhashi et al. | |
| RE39,330 | E * | 10/2006 | Tozawa | G10K 11/002 181/151 |
| 7,461,718 | B2 | 12/2008 | Dedieu et al. | |
| 8,401,216 | B2 | 3/2013 | Rougas et al. | |
| 8,885,865 | B2 * | 11/2014 | Yamagishi | 381/372 |
| 2004/0222038 | A1 | 11/2004 | Nakamura | |
| 2005/0189164 | A1 | 9/2005 | Chang | |
| 2011/0127107 | A1 * | 6/2011 | Tanase et al. | 181/286 |
| 2013/0062139 | A1 * | 3/2013 | Shiozawa | H04R 1/2873 181/175 |

FOREIGN PATENT DOCUMENTS

| | | | |
|---|---|---|---|
| JP | 2008-131199 | A | 6/2008 |
| WO | WO 91/19406 | A1 | 12/1991 |

OTHER PUBLICATIONS

Mechanical English translation of document B2 (JP 3763682 B2) previously filed on Mar. 6, 2014.

Mechanical English translation of document B3 (JP 2008-131199 A) previously filed on Mar. 6, 2014.

* cited by examiner

L
SW1
λ1=2L
22b
20
21b
TUBE LENGTH L
22a
21a
λ1/2
SW2
λ2=L
λ2
SW3
λ3=2L/3
3λ3/2
SW4
λ4=L/2
2λ4
SW5
λ5=2L/5
5λ5/2

ACOUSTIC APPARATUS

CROSS-REFERENCE TO RELATED APPLICATION

The present application claims priority from Japanese Application No. JP 2013-045964. The content of the application is hereby incorporated by reference into this application.

BACKGROUND OF THE INVENTION

1. Field of the Invention

The present invention relates to an acoustic apparatus.

2. Description of the Related Art

It is known that when sound waves of a natural frequency are emitted in space surrounded by walls of acoustic equipment, standing waves are produced by the reciprocal motion of the sound waves between the wall surfaces of the space, which affect the acoustic characteristics of the acoustic equipment. Japanese Patent No. 2606447, Japanese Patent No. 3763682, and Japanese Patent Application Laid-open No. 2008-131199 disclose techniques of suppressing standing waves in a loudspeaker which is one type of acoustic equipment. A speaker apparatus disclosed in Japanese Patent No. 2606447 includes a speaker unit, a cabinet housing the speaker unit, and a Helmholtz resonator provided in the cabinet. A neck length L and a cavity volume V of the Helmholtz resonator in the speaker apparatus are designed in such a way that the Helmholtz resonator resonates at the same frequency as that of standing waves present in the cabinet. When a standing wave is produced in the cabinet of this speaker apparatus, the resonance phenomenon of the Helmholtz resonator occurs, attenuating the standing wave. A speaker apparatus disclosed in Japanese Patent No. 3763682 includes a speaker unit, a cabinet housing the speaker unit, and an acoustic tube (closed tube) having an open end and a closed end. The acoustic tube of the speaker apparatus has a tube length L which is a quarter of a wave length corresponding to the lowest resonance mode of a standing wave produced in the cabinet. This acoustic tube is housed in the cabinet in such a state where the position of its open end comes close to the position of the anti-node (node of the particle velocity) of the sound pressure of the standing wave in the cabinet. When a standing wave (whose wavelength is four times the tube length L) is produced in the cabinet of this speaker apparatus, a resonance wave is produced in the acoustic tube. This resonance wave has a node (anti-node of the particle velocity) of a sound pressure at the open end of the acoustic tube, and an anti-node (node of the particle velocity) of the sound pressure at the closed end. Accordingly, the speaker apparatus relaxes biasing of the distribution of the sound pressure in the cabinet, attenuating the standing wave in the cabinet. Japanese Patent Application Laid-open No. 2008-131199 also discloses a technique similar to the technique of Japanese Patent No. 3763682.

SUMMARY OF THE INVENTION

A speaker apparatus for reproducing high audio frequencies, which is called "tweeter", includes a chamber or a closed tube to widen the reproduction range, at the back of a driver serving as a vibration source. With such a chambered tweeter, a standing wave is likely to be produced in the closed space surrounded by the driver and the chamber. As a result, a large peak dip occurs in the emission characteristics of the tweeter, lowering the sound quality. A possible solution to this problem is to dispose the aforementioned Helmholtz resonator or acoustic tube in the chamber of the tweeter. However, the chamber of the tweeter is a very slender tube body, so that it is difficult to dispose the Helmholtz resonator, the acoustic tube, or the like therein. An effective way of improving the emission characteristics of the tweeter has not been provided.

Accordingly, one object of one or more embodiments of the present invention is to suppress standing waves produced in a chamber in an acoustic apparatus having the chamber, such as a tweeter.

(1) In one or more embodiments of the present invention, an acoustic apparatus includes a vibration part configured to generate an acoustic vibration and a tube having a cavity that faces the vibration part, and at least one open tube connected to the tube via a first open end and a second open end. A length of the at least one open tube is an integer-fold of substantially a half of a wavelength of a standing wave produced in the tube. The first open end is positioned substantially at an anti-node of the standing wave produced in the tube.

(2) In the acoustic apparatus according to (1), the second open end is positioned substantially at a node of the standing wave produced in the tube.

(3) In the acoustic apparatus according to (1) or (2), the first open end and the second open end are positioned at positions apart from each other in an axial direction of the tube by a length of an odd-numbered fold of substantially a quarter of the wavelength of the standing wave.

(4) In the acoustic apparatus according to (1), the second open end is positioned substantially at an anti-node of the standing wave produced in the tube.

(5) In the acoustic apparatus according to one of (1) to (4), at least one of the first open end and the second open end is entirely or partly covered with a permeable sound absorbing material.

(6) In the acoustic apparatus according to one of (1) to (5), the open tube is provided outside the tube.

(7) In the acoustic apparatus according to one of (1) to (6), the first open end is positioned substantially at the anti-node located far from the vibration part.

(8) In the acoustic apparatus according to one of (1) to (7), a number of the at least one open tube is two, and the two open tubes are disposed to face each other across the tube.

(9) In the acoustic apparatus according to (8), the acoustic apparatus further includes a cabinet for housing the vibration part, the tube, and the two open tubes. The two open tubes are provided substantially in parallel to a bottom surface of the cabinet.

(10) In the acoustic apparatus according to (8) or (9), the two open tubes and the tube are formed as an opening of a chamber.

(11) In the acoustic apparatus according to (10), the chamber has a cylindrical chamber body and a wing part that extends sideward from the cylindrical chamber body as the wing part is positioned away from the vibration part. The tube is formed as an opening of the cylindrical chamber body. The two open tubes are formed as through holes of the wing part.

(12) In the acoustic apparatus according to one of (1) to (11), the acoustic apparatus further includes a plurality of the vibration parts that have different frequency characteristics respectively. The tube and the open tube are provided for each of the plurality of the vibration parts except at least the vibration part having a lowest frequency characteristic among the plurality of the vibration parts.

(13) In the acoustic apparatus according to one of (1) to (12), an inside diameter of the open tube is smaller than an inside diameter of the tube.

(14) In the acoustic apparatus according to one of (1) to (13), the acoustic apparatus includes a loudspeaker.

DETAILED DESCRIPTION OF THE INVENTION

Referring to the accompanying drawings, an embodiment of the present invention is described hereinbelow.

Figure 1A:
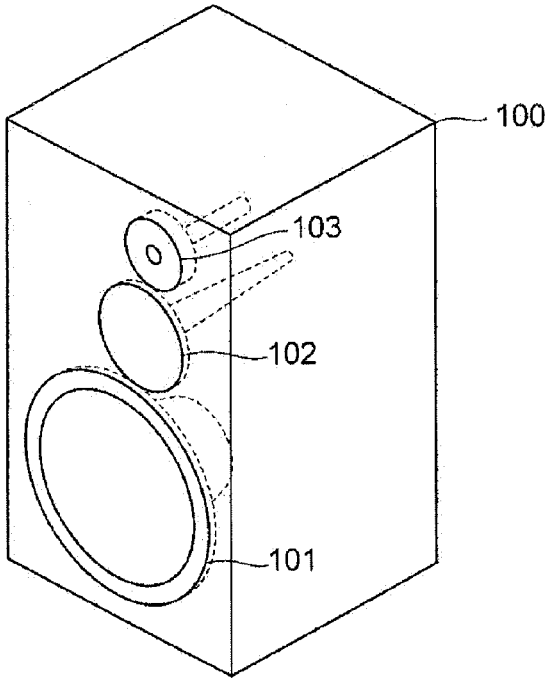
FIG. 1A is a diagram illustrating a 3-way speaker that is one example to which one of more embodiments of the present invention is adapted, and its tweeter.
Figure 1B:
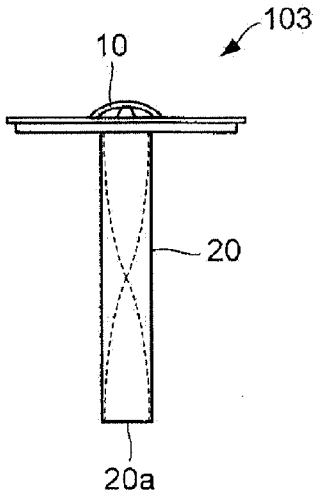
FIG. 1B is a diagram illustrating a 3-way speaker that is one example to which one of more embodiments of the present invention is adapted, and its tweeter.

FIG. 1A is a perspective view illustrating the configuration of a 3-way speaker including a tweeter to which one or more embodiments of the present invention is adapted. As illustrated in FIG. 1A, this 3-way speaker includes a woofer 101, a squawker 102, and a tweeter 103 mounted to the front side of a cabinet 100. FIG. 1B is a side view illustrating the configuration of the tweeter 103. As illustrated in FIG. 1B, the tweeter 103 includes a driver 10 that vibrates in response to an electric signal supplied thereto from an amplifier (not shown), and a chamber 20 enclosing the space facing the back of the driver 10. The chamber 20 is a closed tube whose end opposite to the driver 10 is a closed end.

Figure 2:
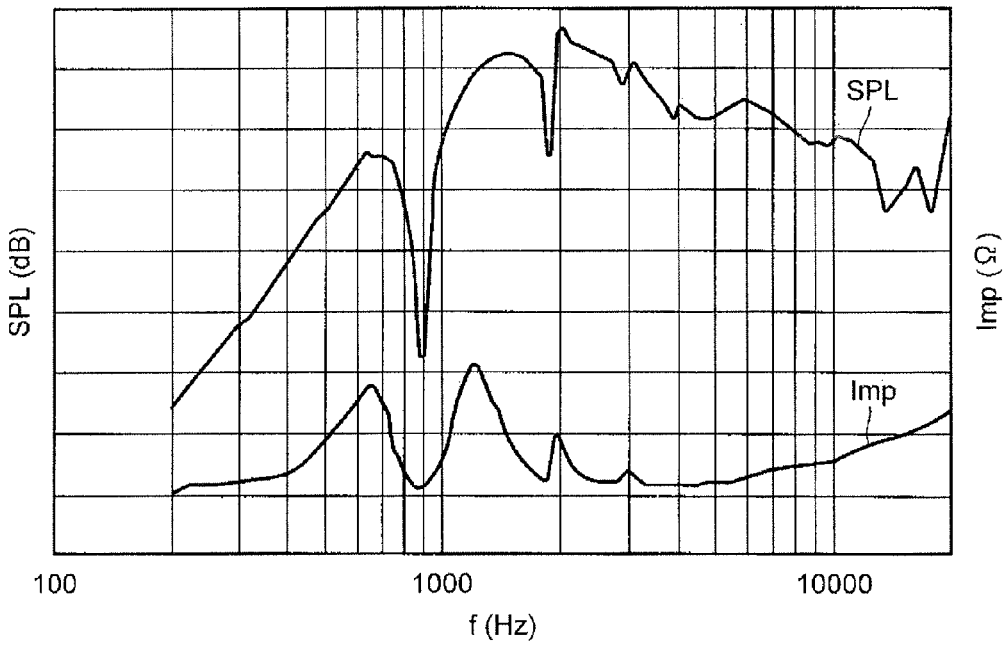
FIG. 2 is a graph showing the acoustic characteristics of a chambered tweeter.

FIG. 2 is a graph showing the frequency characteristics of a sound pressure level SPL and an electric impedance Imp of the tweeter 103. The chamber 20 is provided in the tweeter 103 to widen the reproduction range. The provision of the chamber 20 in the tweeter 103 makes it easier for a standing wave to be produced in the closed space surrounded by the driver 10 and the chamber 20. FIG. 1B exemplifies, with broken lines, the sound pressure waveform of the lowest order (basic mode) in standing waves produced in the closed space surrounded by the driver 10 and the chamber 20. Apparently, the sound pressure waveform of the standing wave in basic mode becomes an anti-node (loop) at the driver 10 and a closed end 20*a* of the chamber 20, and becomes a node at the central position in the chamber 20. A higher-order standing wave having an anti-node of a sound pressure at the driver 10 and the closed end 20*a* of the chamber 20 is produced in the closed space surrounded by the driver 10 and the chamber 20 in addition to the illustrated standing wave in basic mode. As a result, a large peak dip occurs in the sound pressure level SPL emitted by the tweeter 103 and the electric impedance Imp of the tweeter 103, thus lowering the sound quality. It is an object of one or more embodiments of the present invention to suppress production of standing waves in the closed space surrounded by the driver 10 and the chamber 20.

Figure 3:
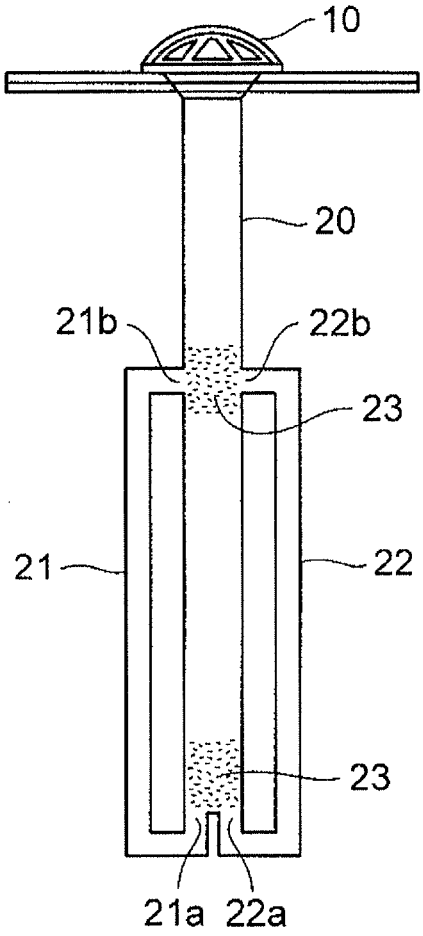
FIG. 3 is a diagram illustrating the configuration of the tweeter of the acoustic apparatus according to an embodiment of the present invention.
Figures 4A, 4B, 4C, 4D, 4E:
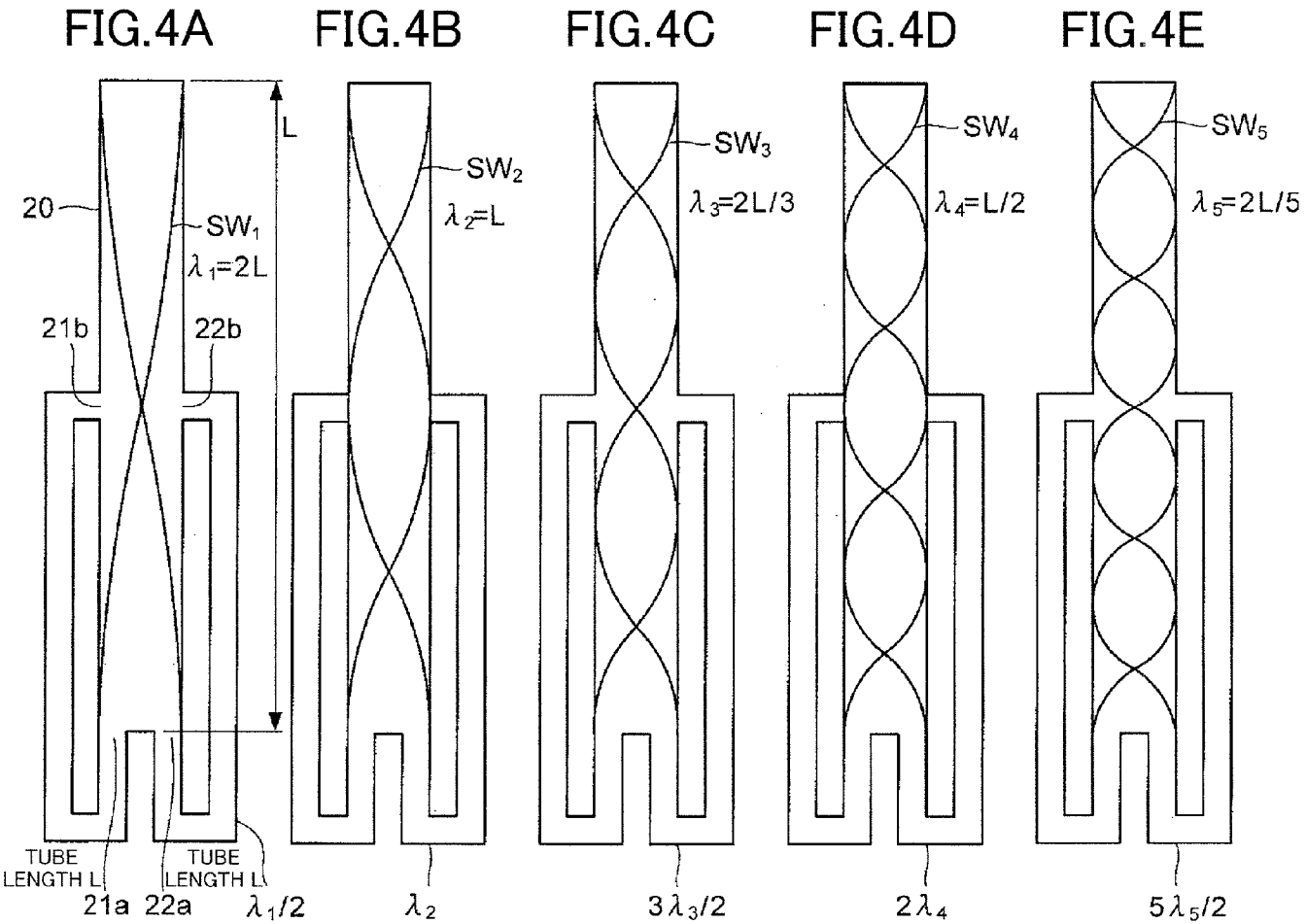
FIG. 4A is a diagram illustrating the operation of suppressing a standing wave according to the embodiment of the present invention.
FIG. 4B is a diagram illustrating the operation of suppressing a standing wave according to the embodiment of the present invention.
FIG. 4C is a diagram illustrating the operation of suppressing a standing wave according to the embodiment of the present invention.
FIG. 4D is a diagram illustrating the operation of suppressing a standing wave according to the embodiment of the present invention.
FIG. 4E is a diagram illustrating the operation of suppressing a standing wave according to the embodiment of the present invention.

FIG. 3 is a side view illustrating the configuration of the tweeter of the acoustic apparatus according to an embodiment of the present invention. As illustrated in FIG. 3, open tubes 21 and 22 are connected to the chamber 20 in the tweeter 103 according to this embodiment. The open tube 21 is a hollow tube having both ends serving as open ends 21*a* and 21*b*, respectively. The open end 21*a* is open at a wall surface near the closed end of the chamber 20 while the open end 21*b* is open at a substantially center wall surface of the chamber 20. The space in the open tube 21 communicates with the space in the chamber 20 through the open ends 21*a* and 21*b*. Likewise, the open tube 22 is a hollow tube having both ends serving as open ends 22*a* and 22*b*, respectively. The open end 22*a* is open at a wall surface near the closed end of the chamber 20 while the open end 22*b* is open at a substantially center wall surface of the chamber 20. The space in the open tube 22 communicates with the space in the chamber 20 through the open ends 22*a* and 22*b*. The open tubes 21 and 22 have the same tube lengths as the tube length of the chamber 20. While two open tubes 21 and 22 are used in this example, the number of the open tubes may be one, or may be three or more. In the camber 20, sound absorbing materials 23 which are permeable sound absorbing materials are respectively disposed in a region near the open ends 21*a* and 22*a*, and a region near the open ends 21*b* and 22*b*. More specifically, in this example, in the chamber 20, the entire regions of both of the two open ends 21*a* and 21*b* of the open tube 21 are covered with the sound absorbing materials, and the entire regions of both of the two open ends 22*a* and 22*b* of the open tube 22 are covered with the sound absorbing materials.

A first feature of this embodiment resides in the open tubes 21 and 22. According to this embodiment, the open tubes 21 and 22 give the following effect. When an electric signal is supplied from the amplifier (not shown), the driver 10 emits sound waves both rearward and forward. The sound waves emitted rearward by the driver 10 propagate through the space in the chamber 20. Frequency components in the sound waves emitted by the driver 10, having a frequency that is the same as the natural frequency in the space in the chamber 20, reciprocate in the chamber 20 between the driver 10 and the closed end of the chamber 20. A plurality of sound waves reciprocally traveling this way are combined to produce standing waves SWk (k=1, 2, . . . ) having a wavelength λk=2L/k (k=1, 2, . . . ) which is 2/k (k=1, 2, . . . ) times a tube length L of the chamber 20.

FIGS. 4A to 4E exemplify sound pressure waveforms of the first-order to fifth-order standing waves SWk (k=1 to 5) produced in the chamber 20 in the above manner. As illustrated in the diagrams, the sound pressure waveforms of those standing waves have anti-nodes near the closed end of the chamber 20. The sound pressure waveforms of the first-order, third-order, and fifth-order standing waves SW1, SW3, and SW5 among those standing waves have nodes near the center of the chamber 20. The open tubes 21 and 22 have the same tube length L as the tube length L of the chamber 20, i.e., the tube length L=kλk/2 which is k/2 (k=1, 2, . . . ) times the wavelength of the standing wave SWk (k=1, 2, . . . ). Therefore, the standing waves SW1, SW3, and SW5 are each phase-delayed by (k/2)×2π during the propagation in the open tubes 21 and 22 from the open ends 21*b* and 22*b*, and reach the open ends 21*a* and 22*a*. Accordingly, the nodes of sound pressure waveforms are produced near the open ends 21*a* and 22*a* in the chamber 20. As a result, the standing waves SW1, SW3, and SW5 are suppressed in the chamber 20.

Regarding the sound pressure component of the second-order standing wave SW2 produced in the chamber 20, the anti-node of a sound pressure opposite in phase to the anti-node of the sound pressure produced at the closed end of the chamber 20 is produced near the center of the chamber 20. The standing wave SW2 is phase-delayed by 2π during the propagation in the open tubes 21 and 22 from the open ends 21*b* and 22*b*, and reaches the open ends 21*a* and 22*a*. In other words, the anti-node opposite in phase to the anti-node of the sound pressure waveform of the standing wave SW2 produced in the chamber 20 reaches near the closed end of the chamber 20 through the open tubes 21 and 22. As a result, the standing wave SW2 in the chamber 20 is suppressed.

Regarding the sound pressure component of the fourth-order standing wave SW4 produced in the chamber 20, the anti-node of a soundpressure in phase to the anti-node of the soundpressure produced at the closed end of the chamber 20 is produced near the center of the chamber 20. The standing wave SW4 is phase-delayed by 4π during the propagation in the open tubes 21 and 22 from the open ends 21*b* and 22*b*, and reaches the open ends 21*a* and 22*a*. Therefore, the fourth-order standing wave SW4 is not suppressed in the chamber 20.

As apparent from the above, according to this embodiment, the connection of the open tubes 21 and 22 to the chamber 20 can suppress the first-order to fifth-order standing waves, except the fourth-order standing wave. Because the anti-nodes of the sound pressures of various standing waves which are to be suppressed are positioned in the center of the chamber 20 in this example, the open ends 21*b* and 22*b* are provided in the center of the chamber 20. When the anti-nodes of the sound pressures of standing waves to be suppressed are produced at positions other than the center of the chamber 20, however, the open ends 21*b* and 22*b* may be provided there.

A second feature of this embodiment resides in the locations of the sound absorbing materials 23. The sound absorbing materials 23 disposed in the region near the open ends 21*a* and 22*a* in the chamber 20 and the region near the open ends 21*b* and 22*b* therein demonstrate the following effect. Those two regions are the boundary regions between the chamber 20 and the open tubes 21 and 22 where the airstream flows fast and the energy of sounds tends to focus in the chamber 20. Therefore, the sound absorbing materials 23 disposed in those regions can efficiently absorb the energy of sounds in the chamber 20. In other words, the sound absorbing materials 23 disposed in the boundary regions between the chamber 20 and the open tubes 21 and 22 can demonstrate the effect of efficiently absorbing the energy of sound from standing waves in the chamber 20.

Figure 5:
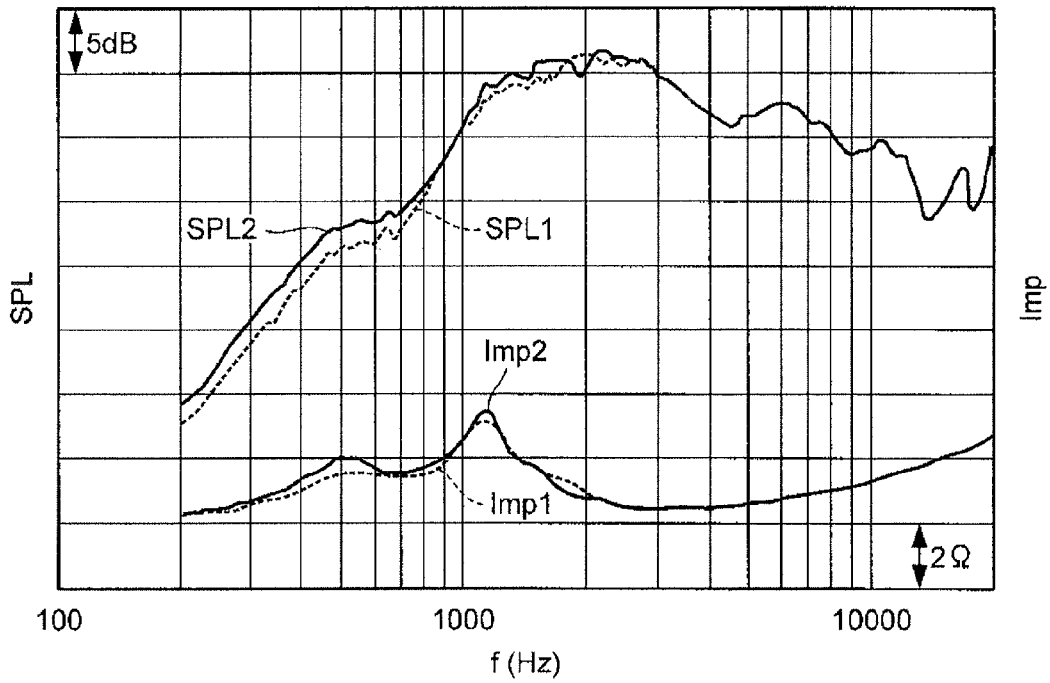
FIG. 5 is a graph showing the effect of the embodiment of the present invention.

The inventors of the present invention conducted simulations to check the effects of this embodiment. Specifically, the sound pressure levels of sounds emitted from the tweeter and the electric impedances of the driver were obtained through simulation while changing the frequency of a test signal supplied to the driver of the tweeter. FIG. 5 shows the results of this simulation. FIG. 5 shows a sound pressure level SPL1 of sounds emitted from the related-art tweeter (see FIG. 1B) and an electric impedance Imp1 when the sound absorbing material is filled in the entire region of the chamber 20, and a sound pressure level SPL2 of sounds emitted from the tweeter according to this embodiment (see FIG. 3) and an electric impedance Imp2. Large peak dips originating from standing waves produced in the chamber 20 appear in the frequency characteristics (see FIG. 2) of the sound pressure level SPL of and the electric impedance Imp of the tweeter in the related-art case where sound absorbing material is not used. The frequency characteristics of the sound pressure level SPL1 of sounds emitted from the tweeter and the electric impedance Imp1 according to this embodiment show that the peak dips are suppressed significantly. Even when the sound absorbing materials are filled in the entire region of the chamber 20 in the related-art tweeter (see FIG. 1B), as in this embodiment, the peak dips in the sound pressure level SPL1 of sounds emitted from the tweeter and the electric impedance Imp1 can be suppressed. In the tweeter according to this embodiment, however, the sound absorbing materials 23 are disposed in about one third of the entire region in the chamber 20. Nevertheless, this embodiment brings about improved acoustic characteristics that do not differ much from the acoustic characteristics in the case where the sound absorbing material 23 is filled in the entire region of the chamber 20 of the related-art tweeter.

As apparent from the above, according to this embodiment, the provision of the open tubes 21 and 22 in the chamber 20 of the tweeter can suppress standing waves produced in the chamber 20, and thus improve the acoustic characteristics of the tweeter. In addition, according to this embodiment, the sound absorbing materials are filled only in the boundary regions with respect to the open tubes 21 and 22 in the chamber 20, thereby saving a large amount of sound absorbing materials as compared to the case where the sound absorbing material is filled in the entire region inside the chamber 20. This leads to cost reduction, and thus a problem which otherwise occurs when a large amount of sound absorbing material is used can be avoided. In other words, when the sound absorbing material is filled in the entire region inside the chamber 20, wave components other than standing waves produced in the chamber 20 are also attenuated, which undesirably affects the acoustic characteristics of the tweeter. When the sound absorbing materials are filled only in the boundary regions with respect to the open tubes 21 and 22 in the chamber 20 according to this embodiment, the adverse influence can be avoided.

Figure 6A:
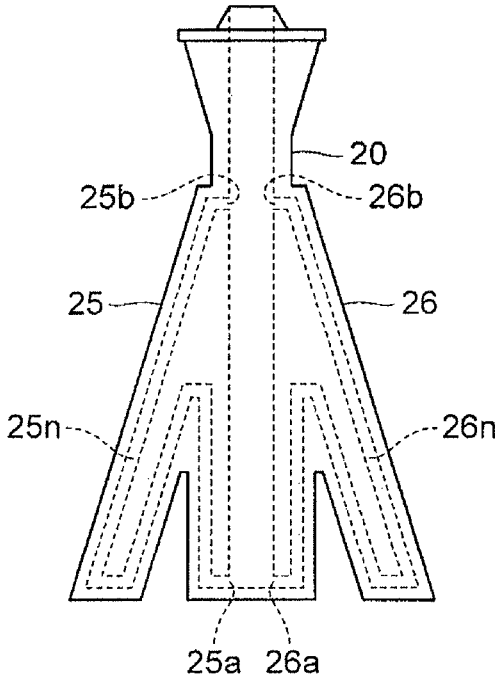
FIG. 6A is a diagram illustrating a first example of a chamber provided with an open tube usable in the embodiment of the present invention.
Figure 6B:
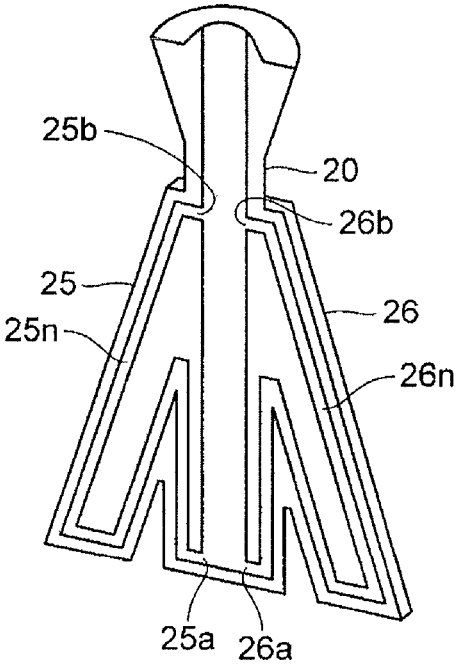
FIG. 6B is a diagram illustrating a first example of a chamber provided with an open tube usable in the embodiment of the present invention.

The following describes specific examples of a chamber provided with an open tube which is usable in this embodiment. FIGS. 6A and 6B illustrate a first example of the chamber provided with an open tube. FIG. 6A is a side view of the chamber provided with an open tube, and FIG. 6B is a view obliquely illustrating the vertical cross section of the chamber provided with an open tube. As illustrated in the diagrams, the chamber provided with an open tube of the first example has flat wing parts 25 and 26 projecting from the left and right sides of the cylindrical chamber 20. A through hole 25*n* reaching an open end 25*b* in a midway of the chamber 20 through an open end 25*a* near the closed end of the chamber 20 is provided inside the wing part 25. A through hole 26*n* reaching an open end 26*b* in a midway of the chamber 20 through an open end 26*a* near the closed end of the chamber 20 is provided inside the wing part 26. The wing part 25 provided with the through hole 25*n* and the wing part 26 provided with the through hole 26*n* serve as open tubes. The length of each of the through holes 25*n* and 26*n* is a half of the wavelength of the lowest-order standing wave among the standing waves to be suppressed. The distance between the position of the open ends 25*a* and 26*a* and the position of the open ends 25*b* and 26*b* in the lengthwise direction of the chamber 20 is a quarter of the wavelength of the lowest-order standing wave among the standing waves to be suppressed.

Figure 7:
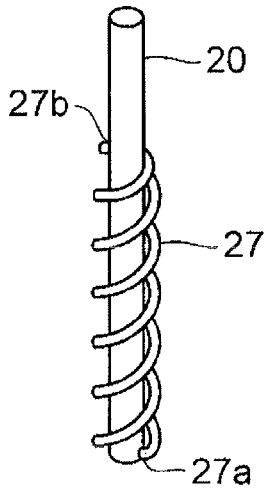
FIG. 7 is a diagram illustrating a second example of the chamber provided with an open tube.

FIG. 7 is a perspective view illustrating a second example of the chamber provided with an open tube. As illustrated in the diagram, the chamber provided with an open tube of the second example has a spiral open tube 27, which is provided to surround the cylindrical chamber 20 and to extend along the axial direction of the chamber 20. A lower end 27*a* and an upper end 27*b* of the spiral open tube 27 are connected to the side surface of the chamber 20 at a position near the closed end and at a midway position of the chamber 20. Two open ends (not shown) that permit a cavity in the open tube 27 to communicate with a cavity in the chamber 20 are respectively provided in the side surface of the chamber 20 near the lower end 27*a* of the open tube 27 and near the upper end 27*b* thereof. The length of the open tube 27 is a half of the wavelength of the lowest-order standing wave among the standing waves to be suppressed. The distance between the position of the lower end 27*a* and the position of the upper end 27*b* of the open tube 27 in the lengthwise direction of the chamber 20 is a quarter of the wavelength of the lowest-order standing wave among the standing waves to be suppressed.

Figure 8:
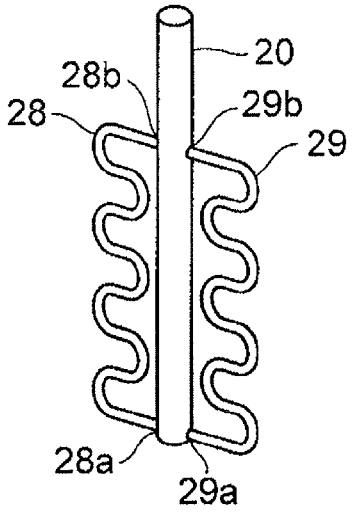
FIG. 8 is a diagram illustrating a third example of the chamber provided with an open tube.

FIG. 8 is a perspective view illustrating a third example of the chamber provided with an open tube. As illustrated in the diagram, the chamber provided with an open tube of the third example has two open tubes 28 and 29 respectively connected to the left and right sides of the cylindrical chamber 20. A lower end 28*a* and an upper end 28*b* of the open tube 28 are connected to the side surface of the chamber 20 at a position near the closed end and at a midway position of the chamber 20. Likewise, a lower end 29*a* and an upper end 29*b* of the open tube 29 are connected to the side surface of the chamber 20 at a position near the closed end and at a midway position of the chamber 20. The open tube 28 extends laterally from the upper end 28*b*, extends downward while repeatedly bending laterally to form a wavy shape, and finally extends laterally to reach the lower end 28*a*. The open tube 29 extends similarly. Two open ends (not shown) that permit a cavity in the open tube 28 to communicate with a cavity in the chamber 20 are respectively provided in the side surface of the chamber 20 near the lower end 28*a* of the open tube 28 and near the upper end 28*b* thereof. Two open ends are similarly provided also in the open tube 29. The length of each of the open tubes 28 and 29 is a half of the wavelength of the lowest-order standing wave among the standing waves to be suppressed. The distance between the position of the lower ends 28*a* and 29*a* and the position of the upper ends 28*b* and 29*b* of the open tubes 28 and 29 in the lengthwise direction of the chamber 20 is a quarter of the wavelength of the lowest-order standing wave among the standing waves to be suppressed.

Figure 9:
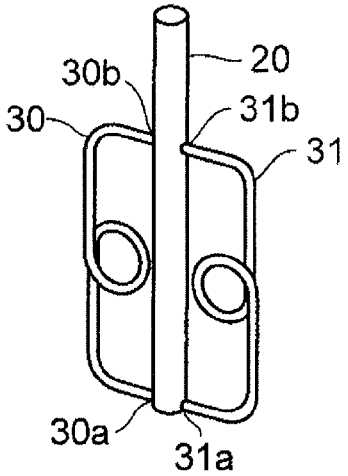
FIG. 9 is a diagram illustrating a fourth example of the chamber provided with an open tube.

FIG. 9 is a perspective view illustrating a fourth example of the chamber provided with an open tube. As illustrated in the diagram, the chamber provided with an open tube of the fourth example has two open tubes 30 and 31 respectively connected to the left and right sides of the cylindrical chamber 20. A lower end 30*a* and an upper end 30*b* of the open tube 30 are connected to the side surface of the chamber 20 at a position near the closed end and at a midway position of the chamber 20. Likewise, a lower end 31*a* and an upper end 31*b* of the open tube 31 are connected to the side surface of the chamber 20 at a position near the closed end and at a midway position of the chamber 20. The open tube 30 extends laterally from the upper end 30*b*, extends downward, extends to form a single loop, extends downward again, and finally extends laterally to reach the lower end 30*a*. The open tube 31 extends similarly. Two open ends (not shown) that permit a cavity in the open tube 30 to communicate with a cavity in the chamber 20 are respectively provided in the side surface of the chamber 20 near the lower end 30*a* of the open tube 30 and near the upper end 30*b* thereof. Two open ends are similarly provided also in the open tube 31. The length of each of the open tubes 30 and 31 is a half of the wavelength of the lowest-order standing wave among the standing waves to be suppressed. The distance between the position of the lower ends 30*a* and 31*a* and the position of the upper ends 30*b* and 31*b* of the open tubes 30 and 31 in the lengthwise direction of the chamber 20 is a quarter of the wavelength of the lowest-order standing wave among the standing waves to be suppressed.

According to the first to fourth examples described above, the open ends of the open tube having an adequate tube length in accordance with the wavelengths of standing waves to be suppressed are provided at proper positions in the chamber, and hence standing waves which are produced in the chamber can be suppressed to improve the acoustic characteristics of the tweeter. Further, arranging sound absorbing materials at the boundary regions with respect to the open tube in the chamber, though not illustrated, can efficiently reduce unnecessary standing waves in the chamber.

OTHER EMBODIMENTS

A limited number of embodiments are described above, and the present invention is not limited to the above embodiments.

In the above-described embodiments, in the chamber, both of the two open ends of the open tube are entirely covered with permeable sound absorbing materials. However, both of the two open ends of the open tube may be covered partly with permeable sound absorbing materials, or one of the two open ends of the open tube may be entirely or partly covered with permeable sound absorbing materials, as long as a sufficient effect of attenuating standing waves is obtained.

In the above-described embodiments, one or more embodiments of the present invention are adapted to a tweeter. However, one or more embodiments of the present invention are not limited to be applied to a speaker such as a tweeter. For example, one or more embodiments of the present invention may be adapted to a muffler of a motorcycle, or may be adapted to a squawker or the like.

In the above-described embodiments, the length of the open tube that connects to the chamber corresponds to a half of the wavelength of the lowest-order standing wave among the standing waves to be suppressed. However, the length of the open tube may not necessarily exactly correspond to a half of the wavelength of the lowest-order standing wave among the standing waves to be suppressed, and has only to be an integer-fold of approximately a half of that wavelength. In this case, effects similar to those of the above-described embodiment can be obtained.

In the above-described embodiments, the positions of the two open ends of the open tube that connects to the chamber are set apart along the axial direction of the chamber by a quarter of the wavelength of the lowest-order standing wave among the standing waves to be suppressed. However, the two open ends may not necessarily be set apart exactly by a quarter of the wavelength of the lowest-order standing wave, and have only to be set apart by an odd-numbered fold of approximately a quarter of that wavelength. In this case, effects similar to those of the above-described embodiment can be obtained.

As illustrated in FIG. 3, for example, in one or more embodiments of the present invention, the open tubes may be provided outside the tube. The open tube may be provided outside the tube. The first open end may be positioned substantially at the anti-node located far from the vibration part. Two open tubes may be disposed to face each other across the tube.

Further, as illustrated in FIG. 1A, for example, in one or more embodiments of the present invention, an acoustic apparatus may include a cabinet for housing the vibration part, the tube, and the two open tubes, and the two open tubes may be provided substantially in parallel to a bottom surface of the cabinet. As illustrated in FIGS. 6A and 6B, for example, each of the two open tubes and the tube may be formed as an opening of a chamber. The chamber may have a cylindrical chamber body and a wing part that extends sideward from the cylindrical chamber body as the wing part is positioned away from the vibration part. The tube may be formed as an opening of the cylindrical chamber body. The two open tubes may be formed as through holes of the wing part.

Moreover, as illustrated in FIG. 1A, for example, in one or more embodiments of the present invention, an acoustic apparatus may include a plurality of the vibration parts that have different sound ranges. The tube and the open tube may be provided for each of the plurality of the vibration parts except at least the vibration part having a lowest sound range among the plurality of the vibration parts.

Furthermore, an inside diameter of the open tube may be smaller than an inside diameter of the tube as illustrated in FIG. 6A to FIG. 9, for example. The acoustic apparatus may include a loudspeaker. The acoustic apparatus may include a speaker.

In addition, the lengths of the tube and the open tubes may be determined based on the length of a portion that has substantially the same diameter. Specifically, in the case illustrated in FIG. 4A, for example, the portion indicated by "L" has substantially the same diameter, and hence this "L" corresponds to the length of the tube.

While the invention has been described with respect to a limited number of embodiments, those skilled in the art, having benefit of this disclosure, will appreciate that other embodiments can be advised which do not depart from the scope of the invention as described therein. Accordingly, the scope of the invention should be limited only by the claims.

What is claimed is:

1. An acoustic apparatus comprising:

a cabinet;

a vibration part configured to generate an acoustic vibration;

a first tube having a cavity that faces the vibration part; and at least one second tube, the second tube being an open tube and being connected to the first tube via a first open end and a second open end, wherein a length of the at least one second tube is an integer-fold of a half of a wavelength of a standing wave produced in the first tube, wherein the first open end is positioned at an anti-node of the standing wave produced in the first tube, and wherein the vibration part, the first tube and the at least one second tube are housed in the cabinet.

2. The acoustic apparatus according to claim 1, wherein the second open end is positioned at a node of the standing wave produced in the first tube.

3. The acoustic apparatus according to claim 1, wherein the first open end and the second open end are positioned at positions apart from each other in an axial direction of the first tube by a length of an odd-numbered fold of a quarter of the wavelength of the standing wave.

4. The acoustic apparatus according to claim 1, wherein the second open end is positioned at an anti-node of the standing wave produced in the first tube.

5. The acoustic apparatus according to claim 1, wherein at least one of the first open end and the second open end is entirely or partly covered with a permeable sound absorbing material.

6. The acoustic apparatus according to claim 1, wherein the second tube is provided outside the first tube.

7. The acoustic apparatus according to claim 1, wherein the first open end is positioned at the anti-node located far from the vibration part.

8. The acoustic apparatus according to claim 1, wherein a number of the at least one second tube is two, and wherein the two second tubes are disposed to face each other across the first tube.

9. The acoustic apparatus according to claim 1 further comprising a plurality of the vibration parts that have different frequency characteristics respectively, wherein the first tube and the second tube are provided for each of the plurality of the vibration parts except at least the vibration part having a lowest frequency characteristic among the plurality of the vibration parts.

10. The acoustic apparatus according to claim 1, wherein an inside diameter of the second tube is smaller than an inside diameter of the first tube.

11. The acoustic apparatus according to claim 1, wherein the acoustic apparatus includes a loudspeaker.

12. The acoustic apparatus according to claim 8, wherein the vibration part, the first tube, and the two second tubes are housed in the cabinet, and wherein the two second tubes are provided in parallel to a bottom surface of the cabinet.

13. The acoustic apparatus according to claim 8, wherein the two second tubes and the first tube are formed as an opening of a chamber.

14. The acoustic apparatus according to claim 13, wherein the chamber has a cylindrical chamber body and a wing part that extends sideward from the cylindrical chamber body as the wing part is positioned away from the vibration part, wherein the first tube is formed as an opening of the cylindrical chamber body, and wherein the two second tubes are formed as through holes of the wing part.

* * * * *